US005095993A

United States Patent [19]

Huber et al.

[11] Patent Number: 5,095,993

[45] Date of Patent: Mar. 17, 1992

[54] ANCHOR APPARATUS FOR A TUBING AND WIRELINE CONVEYED METHOD AND APPARATUS

[75] Inventors: Klaus B. Huber, Missouri City; Joe C. Hromas, Suger Land; Arnold G. Edwards, Hockley, all of Tex.

[73] Assignee: Schlumberger Technology Corporation, Houston, Tex.

[21] Appl. No.: 616,045

[22] Filed: Nov. 20, 1990

Related U.S. Application Data

[62] Division of Ser. No. 451,279, Dec. 15, 1989, Pat. No. 5,025,861.

[51] Int. Cl.[5] ..... E21B 23/00

[52] U.S. Cl. ..... 166/382; 166/217

[58] Field of Search ..... 166/217, 216, 382, 206, 166/207, 208

[56] References Cited

U.S. PATENT DOCUMENTS

| | | | |
|---|---|---|---|
| 2,670,797 | 3/1954 | Armentront | 166/208 X |
| 3,079,177 | 2/1963 | Valvoord et al. | 166/208 X |
| 4,349,072 | 9/1982 | Escaron et al. | 166/383 X |
| 4,488,595 | 12/1984 | Akkerman | 166/206 |
| 4,498,534 | 2/1985 | Lindsey, Jr. | 166/216 X |
| 4,690,214 | 9/1987 | Wittrisch | 166/250 |

*Primary Examiner*—Hoang C. Dang

*Attorney, Agent, or Firm*—Henry N. Garrana; John H. Bouchard

[57] ABSTRACT

A new method of standalone perforating comprises the steps of lowering a perforator part-way into a borehole on a tubing string; when perforating is desired, connecting a wireline to the perforator; disconnecting the perforator from the tubing string; lowering the perforator into the borehole to the desired depth; attaching the perforator to the borehole casing or formation by setting an anchor on the perforator; disconnecting all wireline and associated apparatus from the perforator; withdrawing the wireline apparatus to the well surface; with the perforator standing alone in the well, firing the perforator into the surrounding formation; and dropping the perforator to the bottom of the well. A new apparatus for releasing the perforator from the tubing string includes a neutral release latch mechanism, and a new anchoring apparatus includes two interleaved coil springs having beveled shaped surfaces. Compression of an inner coil spring forces a radial expansion of an outer slip coil spring until the slip coil spring contacts the borehole wall and sets the anchor.

8 Claims, 8 Drawing Sheets

FROM FIG.5

12
12b
12a
18
18h
18q
18b
18f
18k
18g
18l
18c
18m
18n
18j
18q
18a2
18a1
18p
18d

ANCHOR APPARATUS FOR A TUBING AND WIRELINE CONVEYED METHOD AND APPARATUS

This is a division of application Ser. No. 07/451,279 filed 12/15/89, now U.S. Pat. No. 5,025,861.

BACKGROUND OF THE INVENTION

The subject matter of the present invention relates to a perforating method and apparatus, and more particularly, to a perforating method wherein a perforating gun is lowered into a well to a first depth on tubing, subsequently lowered further into the well to a second depth on wireline, anchored to the well casing, and all wireline apparatus is disconnected from the perforating gun and withdrawn from the wellbore prior to performing a standalone perforation operation.

Various techniques have been utilized for perforating a well casing. One such technique is disclosed in U.S. Pat. No. 4,349,072 to Escaron et al. This technique involves lowering tubing into a borehole, such as a deviated well, the tubing including a well instrument, such as a perforating gun, and subsequently lowering the well instrument further into the borehole via wireline. When the instrument is lowered to its desired location in the well, on wireline, the well instrument is activated. In the case of a perforator, the perforator is discharged into the formation. Another similar technique, although not involving a perforator, is disclosed in U.S. Pat. No. 4,690,214 to Christian Wittrisch. In the Wittrisch patent, a tubing including a well instrument is lowered into the well, the well instrument being subsequently lowered into the well via wireline. The instrument is anchored to the well casing, and the wireline tension is reduced, prior to performing a measurement function. Although the well instrument is not disclosed as being a perforator, the wireline remains attached to the well instrument during the measurement function. When the well instrument is a perforating gun, in hot, deep wells, after the perforating gun is lowered into the well on wireline, it is not desirable that the wireline remain connected to the perforating gun. If the wireline remains connected to the gun, it must be sealed off at the surface during perforation to provide for safe pressure control. This is accomplished by using a lubricator and a riser, the lubricator containing many seals and connections. In addition, if the wireline remains connected to the gun when the well produces, the wireline and other tools most subsequently be retrieved from the sell against significant well fluid pressure. Furthermore, if the wireline remains connected to the gun, during perforation, the wireline may accidently disconnect from the gun and blow upwardly toward the surface of the well thereby creating a "birdsnest"; as a result, an expensive fishing operation would be required for untangling the wireline and retrieving the perforating gun. In hostile environments, such as $H_2S$, the wireline may be damaged if it remains in the borehole for long peroids of time. In addition, if the wireline remains connected to the gun, the wireline itself may represent an obstruction with respect to unrestricted flow of well fluid from the perforated openings in the formation to the well surface. It is more desirable that the perforating gun "standalone" in the well, that is, that it be anchored to the well casing, and all wireline be withdrawn to the well surface prior to discharging the perforating gun into the formation. As a result, an unrestricted flow of well fluid toward the surface is obtained. In addition, a safer perforation operation is performed, since there is no wireline to obstruct or otherwise complicate the perforation operation. Since a wireline is not connected to the gun, a simple master valve may be provided below the lubricator for surface pressure control. The master valve provides for safe operation and it minimizes the amount of perforating equipment components utilized downhole.

SUMMARY OF THE INVENTION

Accordingly, it is a primary object of the present invention to disclose a new method of performing a standalone operation wherein a well instrument is lowered into a borehole, anchored to the borehole casing, and all other apparatus is withdrawn from the borehole thereby leaving the well instrument standing alone in the borehole, the well instrument subsequently performing its functional operation while anchored to the borehole casing.

It is a further object of the present invention to disclose a new method of performing the standalone operation using a perforating gun in lieu of the well instrument.

It is a further object of the present invention to use a perforating gun to underbalance perforate a liner in a borehole without a tubing, a wireline, or other such conveyor attached to the perforating gun at the time of shot, surge, and production from the perforated borehole.

It is a further object of the present invention to disclose a new method of performing the standalone operation using a new and novel inductive coupler and anchoring apparatus to anchor the perforating gun to the borehole casing.

It is a further object of the present invention to disclose a new method of perforating a borehole casing using a section of tubing, a wireline, a perforating gun initially connected to the tubing and subsequently connected to the wireline, the perforating gun including a new latch for releasing the perforating gun from the tubing and a new anchor for anchoring the perforating gun to the borehole casing, wherein the tubing and attached perforating gun is lowered to a first depth of the well, the perforating gun is attached to the wireline, the latch which connects the perforating gun to the tubing is released, the perforating gun is lowered to a second depth of the well on wireline, the anchor on the gun is set thereby firmly attaching the gun to the borehole casing, and the wireline and associated apparatus is withdrawn from the well thereby leaving the perforating gun standing alone in the borehole for subsequent use in perforating the borehole casing.

It is a further object of the present invention to provide a new and novel latch for attaching the perforating gun to the tubing wherein the latch releases the perforating gun from the tubing only when an upward pull on the wireline connected to the gun equals a downward weight of the perforating gun thereby preventing a sudden pull or jerk on the wireline from breaking or otherwise damaging the wireline.

It is a further object of the present invention to provide a new and novel anchor for anchoring the perforating gun to the borehole casing including an inductive coupler for generating an electrical signal, a setting tool for providing an upward pulling force on a first inner member of the anchor and a downward force against an outer member, the anchor including a second coil interleaved with the first coil, the second coil expanding radially outwardly when the upward pulling force is applied to the first coil of the anchor.

These and other objects of the present invention are accomplished by designing a new and novel perforating method and apparatus which allows a user to first lower the perforator only part-way into a wellbore on tubing, and, when it is desired to perforate a wellbore formation, to attach a wireline to the perforator, release the perforator from the tubing when an upward pull on the wireline substantially equals a downward weight of the perforator, lower the perforator further into the wellbore to the desired depth on wireline, anchor the perforator to the wellbore casing, detach the wireline from the perforator, and withdraw the wireline to the well surface. This new standalone perforating method is especially useful in conjunction with hot, deep wells. In hot, deep wells, when the perforator is lowered to the desired depth on tubing, if it remains at the desired depth for a period of time prior to perforation, the explosive charges, contained in the perforating gun, would be damaged and would exhibit reduced performance by the hot temperatures existing in the well. however, it would be advantageous to complete the well with guns and an anchor which are larger than the tubing but are not exposed to full temperature and pressure for an extended period of time. Furthermore, it would also be advantageous to temporarily leave the well, with tubing and perforator installed, for a period of time prior to actual performance of the perforation operation. Therefore, in order to allow an operator to complete the well installations and wellhead a period of time prior to perforation without also damaging the explosives in the perforating gun (especially when the guns and anchor are larger than the tubing), the gun is first lowered, on tubing, to a depth in the well where the temperatures do not exceed a threshold amount and the shape charges and other explosive components in the gun are not damaged by such temperatures; the gun may then be temporarily abandoned for a period of time; subsequently, the gun is released from the tubing and lowered into the well on wireline; since the temperature at this new, deeper depth is very high, the gun is anchored to the wellbore casing and the wireline is withdrawn from the new, deeper depth. In a relatively short time, the gun is quickly detonated before the temperatures damage the explosives in the gun.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figure 1:
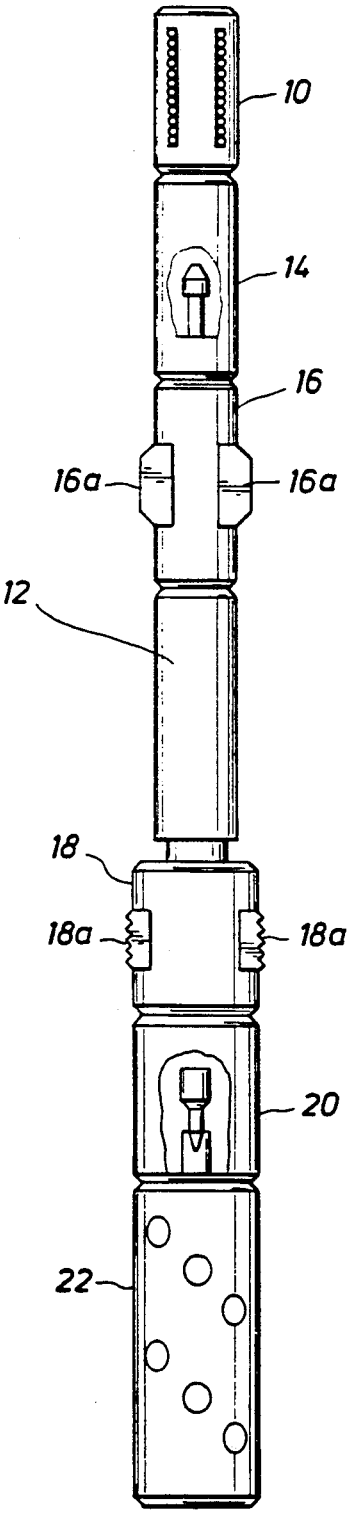
FIG. 1 illustrates a typical tool string lowered into a borehole on a tubing string.

Referring to FIG. 1, a typical tool string, adapted to be lowered into a borehole on a tubing string, is illustrated. In FIG. 1, the tool string comprises an inductive coupler 10 including a female coil and a male coil associated with the female coil, the female coil including an electrical conductor which connects to an anchor setting tool 12 to be discussed below. The inductive coupler 10, and associated male and female coils, will be discussed with reference to FIG. 4 and is similar to the inductive coupler disclosed in U.S. Pat. No. 4,806,928 to Veneruso, the disclosure of which is incorporated by reference into this specification. A wireline latch 14 and associated tubing latch/neutral release 16 are interconnected between the inductive coupler 10 and the anchor setting tool 12. The electrical conductor from the inductive coupler 10 is connected to the setting tool 12 is provided for generating an electrical initiator signal. The setting tool 12 may comprise, for example, the "Casing Packer Setting Tool (CPST)", models BA, CA, and AA, made by Schlumberger Technology Corporation. The setting tool 12 may also comprise a setting tool manufactured by Baker/Hughes, models 05, 10, and 20. The "CPST" setting tool 12, manufactured by Schlumberger, is activated by the electrical initiator signal which ignites a flammable solid. A gas pressure created from the flammable solid causes the tool to expand, the expansion causing relative axial motion to occur between the setting tool outer housing and its inner mandrel. The tubing latch/neutral release 16 includes latch dogs 16*a* adapted for connection to a portion of a tubing string, to be illustrated and discussed in detail later in this specification. An anchor 18 is connected to the anchor setting tool 12, the anchor 18 including a slip coil 18*a* adapted for attachment firmly to a borehole casing. The anchor setting tool 12 includes an electrical initiator for receiving the electrical initiator signal from the female coil disposed in the inductive coupler 10 and setting the anchor 18 in response thereto, and in particular, for expanding the radial dimension of the slip coil 18*a* in response to the relative motion of two sleeves in the anchor setting tool 12. A firing system 20 is attached to the anchor 18 for firing a perforating gun 22 in response to different types of stimuli, such as a pressure increase or decrease in the borehole.

Referring to FIGS. 2*a* through 3*c*, a series of events, illustrating a method of perforating a borehole casing or formation, comprises, in chronological order:

(1) a tool string is latched to a tubing and lowered to a first predetermined depth of the borehole;

(2) a perforating gun, with wireline, is released from the tubing and lowered to a second predetermined depth of the borehole;

(3) a perforating fun anchor is set, anchoring the perforating gun to the borehole casing;

(4) the wireline is withdrawn from the borehole;

(5) the perforating gun perforates the borehole;

(6) the perforating gun anchor is released; and (7) the perforating gun is dropped to the bottom of the well.

Figure 2A:
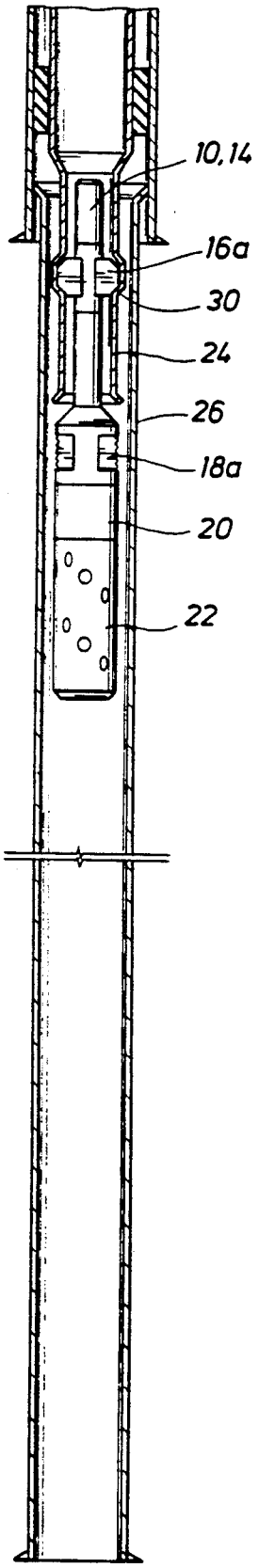
FIGS. 2*a*–3*c* illustrate a series of events, in chronological order, depicting the tool string on tubing in a borehole and a subsequent wireline conveyed perforating gun anchored to the borehole casing without the wireline.

In FIG. 2*a*, the tool string of FIG. 1 is run into the borehole 26, to a first predetermined depth, or production tubing 24, and a permanent packer is set. The tool string is latched to the production tubing 24 via latch dogs 16*a*. The latch dogs 16*a* rest on a shoulder 30 supporting the weight of the tool string. As will be set forth in more detail later in this specification, the latch dogs 16*a* are prevented from retracting radially inward. Anchor 18 is not yet set (slip coil 18*a* is in a non-expanded position) and the toll string is not connected to a wireline.

Figure 2B:
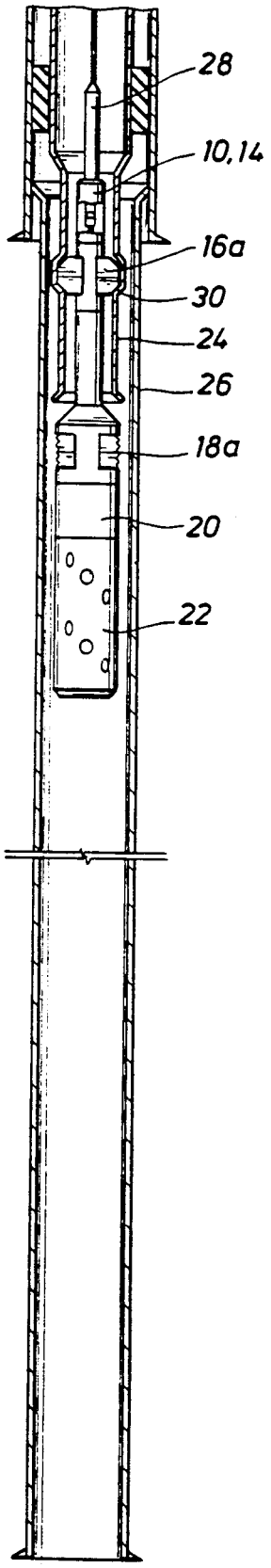

In FIG. 2*b*, a wireline 28, including a male coil of the inductive coupler 10, is connected to the wireline latch 14 of the tool string, at which time, the male coil of the inductive coupler 10 is aligned with the female coil of the inductive coupler 10. As in FIG. 2*a*, the tool string is latched to the production tubing 24 via latch dogs 16*a*, and the anchor 18 is not yet set.

Figure 2C:
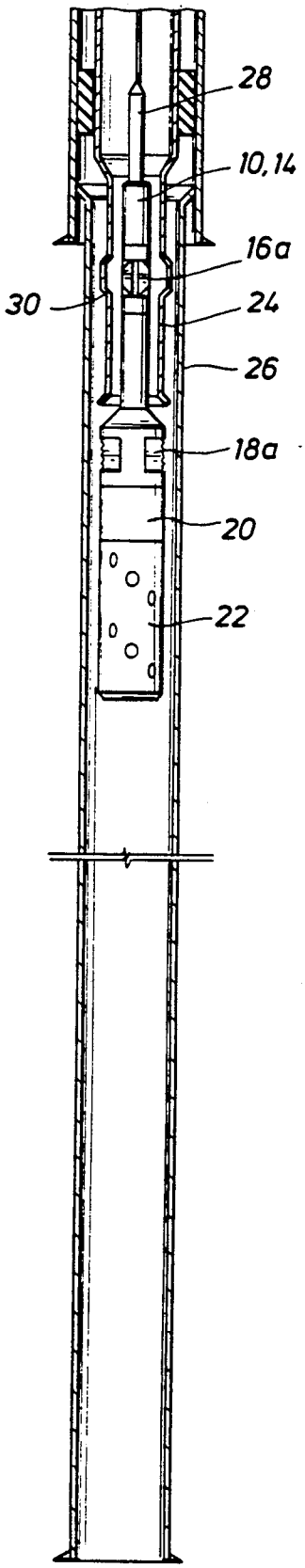

In FIG. 2*c*, utilizing the latch dog 16*a* neutral release mechanism, the tool string is released from the tubing 24. More particularly, in response to a pull upward on the wireline 28, when the upward force on the wireline 328 resultant from the pull upward substantially equals a downward force resultant from the weight of the perforating gun 22, the latch dogs 16*a* retract radially inward, off shoulder 30 of the production tubing 24. The latch dogs 16*a* will not retract until the entire weight of the tool string is on the wireline 28, thereby preventing a sudden jerk on the wireline from breaking the wireline. The weight of the tool string in FIG. 2*c* is now supported by the wireline 28. This latch dog 16*a* neutral release mechanism will be set forth in more detail later in this specification.

Figure 3A:
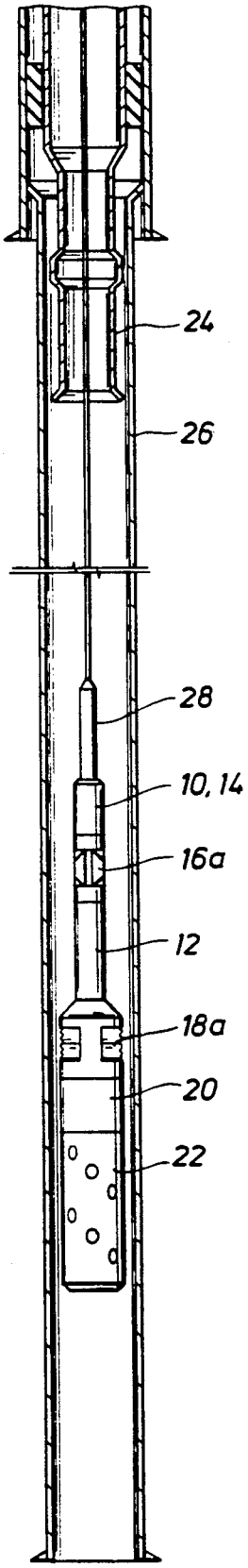

In FIG. 3*a*, the tool string is lowered to a second depth in the borehole 26 via wireline 28, the wireline supporting the weight of the tool string. Anchor 18, and slip coil 18*a*, are not yet set.

Figure 3B:
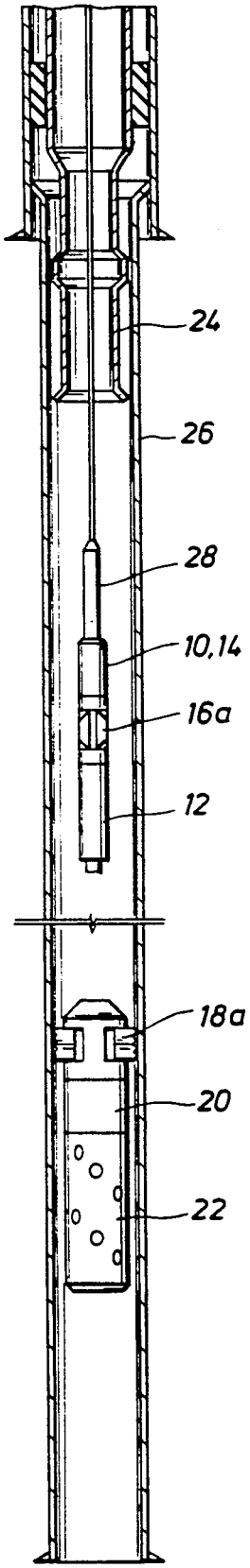

In FIG. 3*b*, the female coil of the inductive coupler 10 transmits an electrical initiating signal to the setting tool 12. In the CPST setting tool 12, manufactured by Schlumberger Technology Corporation, a flammable solid is ignited and the gas pressure created from the flammable solid causes the tool 12 to expand and create a relative axial motion between the setting tool outer housing and the inner mandrel. As a result of this relative axial motion, slip coil 18*a* expands radially outward, thereby firmly gripping the borehole casing 26. At this point, the anchor setting tool 12 physically separates from the anchor 18; and the setting tool 12, the tubing latch/neutral release 16, the wireline latch 14, and the inductive coupler 10 are pulled to the well surface, leaving the anchor 18, firing system 20 and HSD perforating gun 22 disposed downhole, standing along, anchored to the borehold casing 26.

Figure 3C:
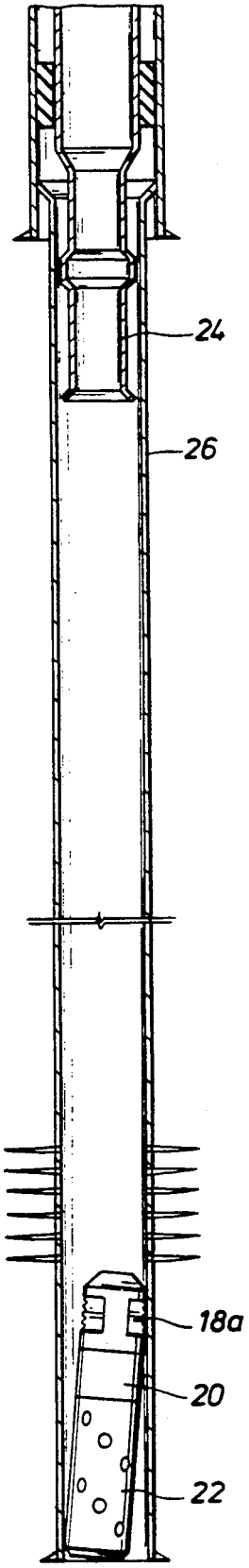

In FIG. 3*c*, in response to an input stimuli in the borehole, such as a pressure increase or decrease in the borehole, the firing system 20 fires the perforating gun 22, and the anchor 18 releases in response to pressure or shock created by the high order of the perforating gun, i.e., the slip coil 18*a* retracts radially inward, allowing the perforating gun 22 to drop to the bottom of the borehole 26. The well is now free to flow unrestricted through the wellbore liner and production tubing 24.

This method of perforating, as described above with reference to FIGS. 2*a*–3*c*, is particularly useful in hot, deep wells. Due to the temperature of the well at a second depth, it is not desirable to run the perforating gun 22 into the borehold, to the second depth as shown in FIG. 3*b*/3*c*, on production tubing and to leave the gun in the borehole at the second depth for long periods of time. If the gun were left in the borehole at the second depth for long periods, the charges in the perforating gun 22 would suffer from heat related damage. Therefore, one solution is to run the perforating gun into the borehole on production tubing 24 to a first depth, where the first depth is about half the second depth, as shown in FIG. 2*a*–2*c*, since the temperature at this first depth is much lower than the temperature at the second depth. Subsequently, when the user is ready to perforate the formation, the perforating gun 22 is run to the second depth of the borehole on wireline 28, anchored to the borehole casing 26, and the wireline 28, as well as other none-essential tool string equipment, is withdrawn to the well surface. As a result, by completing the well and perforating the well following one trip into the well on tubing and one trip further into the well on wireline, a "standalone" perforation operation is achieved thereby providing, among other things, an unrestricted flow of well fluid toward the well surface.

A functional description of the new method of perforating a borehole casing in accordance with the present invention will be set forth in the following paragraphs with reference to FIGS. 2*a*–2*c* of the drawings.

The tool string of FIG. 1 is run into a borehole 26 on production tubing 24 to a first depth. Ultimately, it is desired to perforate a borehole casing at a second depth, where the second depth is about twice the first depth. A permanent packer is set, and, when the tool string is disposed on the production tubing 24 at the first depth, the well head is secured. For hot, deep wells, in order to prevent damage to the charges in the perforating gun, it is desirable to secure the gun, on the tubing, at the first depth of the well, and not the second depth, since the temperature at the first depth is much less than the temperature at the second depth. The shape charges in the perforating gun 22 may remain undamaged at the first depth of the well for a long period of time. When it is desired to perforate the formation at the second depth, the tool string is lowered to the second depth of the well. However, when the tool string is disposed at the first depth of the well, it is latched to the shoulder 30 fo the production tubing 24 via the latch dogs 16*a*, and the weight of the tool string of FIG. 1 is supported by latch dogs 16*a* on shoulder 30. As will be discussed in more detail later, the latch dogs 16*a* remain latched to the shoulder 30 until an upwardly directed force due to a pull upwardly on wireline 28 substantially equals a downwardly directed weight of the perforating gun, at which time, the latch dogs 16*a* retract radially inwardly, and off shoulder 30. When the tool string is run into the borehole 26 on the tubing 24 to the first depth, and the well head is secured, when desired, a wireline 28 is run into the well and secured to the wireline latch 14, in a manner which will also be discussed in more detail later. When the wireline 28 is secured, if a force upward resultant from an upward pull on the wireline 28 substantially equals a force downward resultant from a downward weight of the perforating gun 22, the latch dogs 16a retract radially inward. This is the function of the so-called "neutral release" mechanism of the latch 16a, which will be discussed in more detail later in this specification. At this time, the weight of the tool string is supported by the wireline 28 and not by the latch dogs 16a on shoulder 30. It is important to note that this "neutral release" condition (when wireline pull must equal gun weight before the latch dog 16a releases) prevents a jumping or jerking wireline cable from releasing the latch dogs 16a; and the neutral release condition prevents a jump or jerk on the cable from breaking or damaging the cable. When it is desired to perforate the borehold casing, the tool string is lowered into the well via the wireline 28. When the tool string is disposed at the second depth of the well, the anchor 18 is set, i.e., the slip coil 18a expands radially outward, in contact with the borehole casing 26. When the anchor 18 is set, the portion of the tool string including the anchor setting tool 12, tubing latch/neutral release 16, wireline latch 14, and inductive coupler 10 is withdrawn to the surface, leaving the perforating gun 22 and attached firing system 20 anchored to the borehole casing 26. When perforation of the casing 26 is desired, an input stimulus is transmitted down the borehole, such as a pressure increase or decrease. This initiates the activation of the firing system 20 and the discharging of the perforating gun 22 into the casing 26. When the perforating gun is discharged, the anchor 18 is released, and the gun 22 falls down to the bottom of the borehole.

Figure 4:
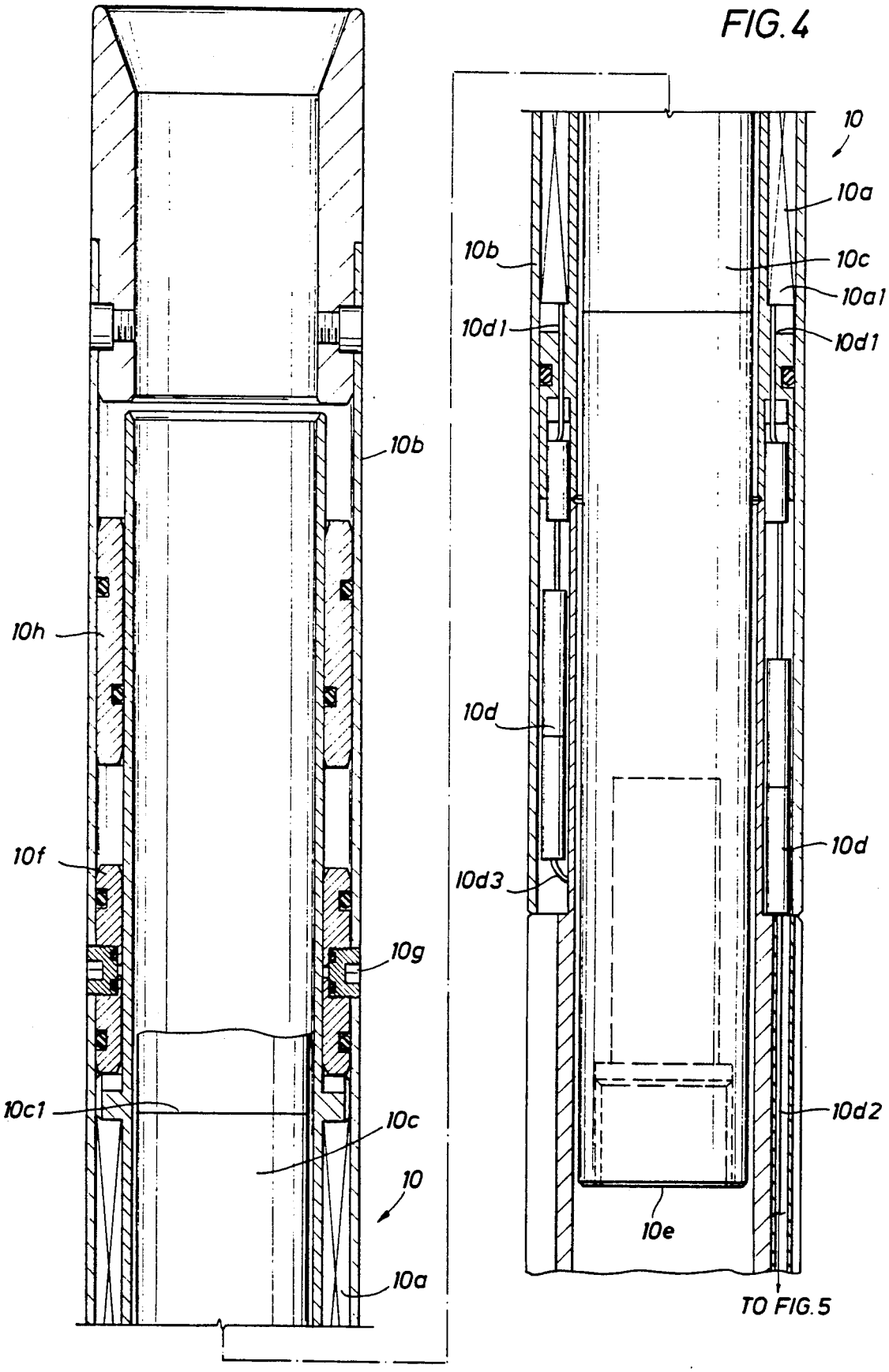
FIG. 4 illustrates the inductive coupler of FIG. 1.

Referring to FIG. 4, a more detailed construction of the inductive coupler 10 is illustrated.

Figure 5:
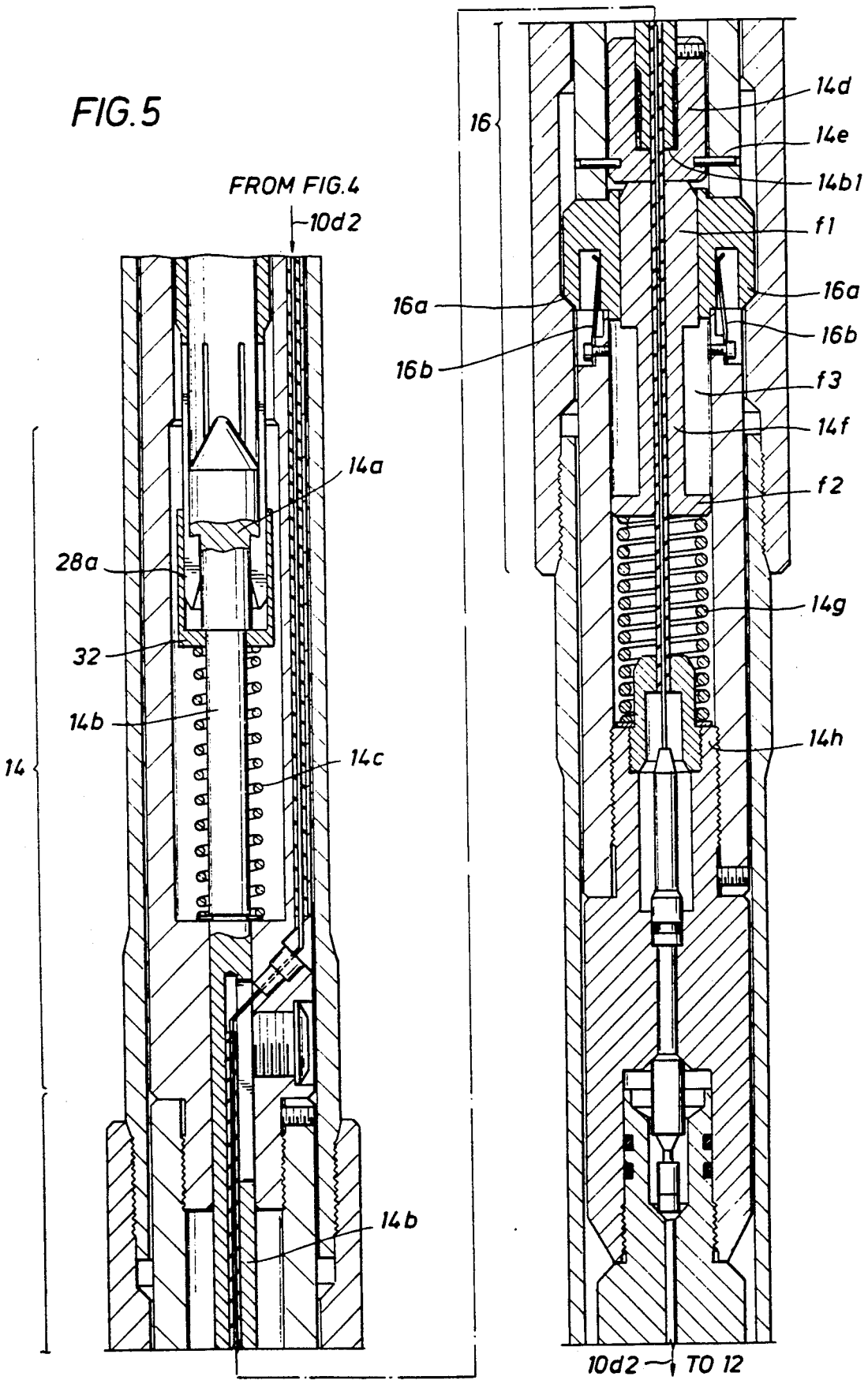
FIG. 5 illustrates the tubing latch neutral release of FIG. 1 connected to the inductive coupler of FIG. 4.

In FIG. 4, the inductive coupler 10 of FIG. 1 comprises a female coil 10a disposed between an inner wall and an outer wall of a housing 10b; a male coil 10c disposed concentrically within the female coil 10a and adapted to be connected, as at 10c1, to a wireline; an electrical connector 10d disposed on one side of the female coil 10a and having a first electrical conductor end 10d1 which is electrically connected to a conductor end 10a1 of the female coil 10a, a second electrical conductor end 10d2 connected the setting tool 12 and a ground wire 10d3; an internal end piece 10e disposed on the one side of the female coil 10a and adapted for connection to a wireline overshot 28a shown in FIG. 5 and discussed later in this specification; a fill ring 10f with enclosed filler plug 10g disposed on the other side of the female coil 10a; a compensating piston 10h disposed on the other side of the female coil 10a, a space between the compensating piston 10h and the fill ring 10f being filled with silicone oil (the entire coil cavity is filled with silicone oil all the way down to the o-rings below the first electical conductor end 10d1).

In operation, referring to FIG. 4, the inductive coupler 10 operates by concentrically disposing the male coil 10c within the female coil 10a in housing 10b. When the male coil 10c is disposed concentrically with respect to the female coil 10a, as shown in FIG. 4, a current in the male coil induces an electrical initiator signal in the female coil via a magnetic inductive coupling; the electrical initiator signal is transmitted from the female coil 10a to connector 10d via conductor 10d1 and from connector 10d to the wireline latch 14, from wireline latch 14 to tubing latch/neutral release 16, and from latch 16 to setting tool 12 via conductor 10d2.

Referring to FIG. 5, a detailed construction of the wireline latch 14 and the tubing latch/neutral release 16 is illustrated.

In FIG. 5, the wireline latch 14 comprises a fishing neck 14a, the neck 14a including an inward recess or shoulder, at 14a, adapted for holding or retaining a collet finger overshot 28a of wireline 28. A center shaft 14b is connected to fishing neck 14a. A biasing spring 14c enclosing a portion of the center shaft 14b provides a biasing force on a locking sleeve 32. The locking sleeve 32 movably retains the overshot 28a after the overshot has expanded over the fishing neck 14a and locks the overshot 28a into the position shown in FIG. 4 when the overshot 28a pulls up on the fishing neck 14a. A cylindrical member 14d encloses an end 14b1 of the center shaft 14b, and is held in place by shear pins 14e . A further cylindrical 14f, cross-sectionally shaped in the form of the letter "I", includes a top part f1 and a bottom part f2, the top part f1 and the bottom part f2 defining a recess f3 disposed therebetween. THe top part f1 of the I-shaped further cylindrical member 14f is disposed between the latch dogs 16a and therefore holds each latch dog 16a in its radially outward position. As a result, the latch dogs 16a are constrained to rest on shoulder 30 of the production tubing 24. A set of biasing leaf springs 16b urge the latch dogs 16a radially inward, even though the top part f1 of the I-shaped further cylindrical member 14f is disposed between the latch dogs 16a and holds each latch dog 16a in its radially outward position. A coiled spring 14g is biased in compression between the bottom part f2 of the further cylindrical member 14f and a stop 14h. The stop 14h is fixed. Therefore, the spring 14g tends to push the further cylindrical member 14f upwardly in the figure.

A functional description of the wireline latch 14 and the tubing latch/neutral release 16 will be set forth in the following paragraph with reference to FIG. 5 of the drawings.

In FIG. 5, overshot 28a of wireline 28 pulls upwardly on fishing neck 14a. When the upward force of the pull of wireline 28 substantially equals the downward weight of the gun 22, a "neutral condition" is created. Therefore, except for the force provided by coiled spring 14g, no net force exists. However, due to the net upward force provided by coiled spring 14g, the center shaft 14b, as well as the cylindrical member 14d, after shearing the shear pins 14e, moves upwardly in the figure in response to the upward push on the center shaft 14b by coiled spring 14g. As cylindrical member 14d moves upwardly, after shearing of the shear pins 14e, spring 14g continues to push the I-shaped further cylindrical member 14f upwardly in the figure. When wireline pull substantially equals gun weight, the top part f1 of the further cylindrical member 14f moves out from between the two latch dogs 16a and both recesses f3 eventually come into alignment between the two latch dogs 16a. The latch dogs 16a are urged into the recess f3 by the pair of biasing leaf springs 16b. As a result, the latch dogs 16a move into the recesses f3.

Figure 6:
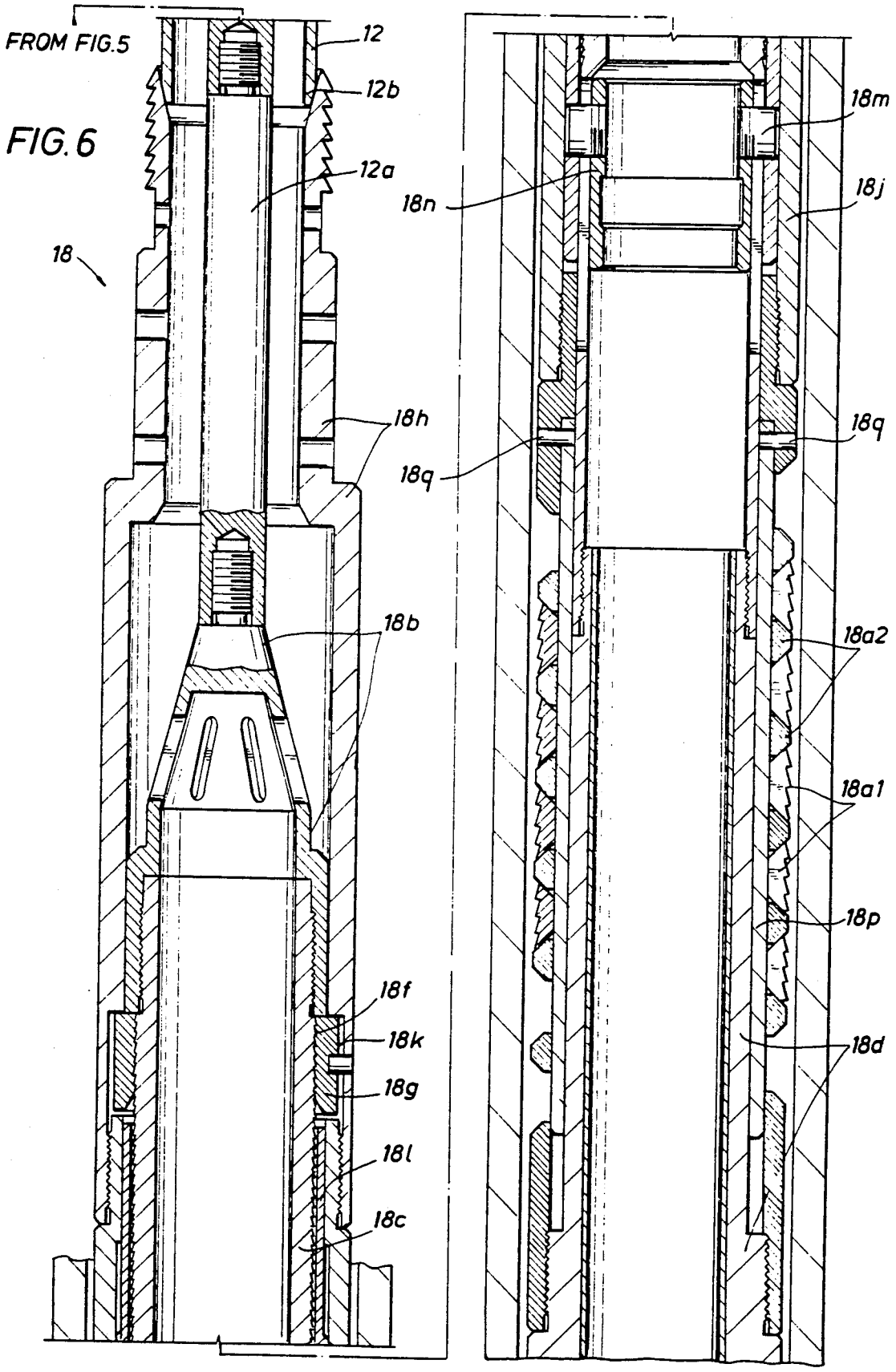
FIG. 6 illustrates the anchor of FIG. 1 when the anchor is not set.
Figure 7:
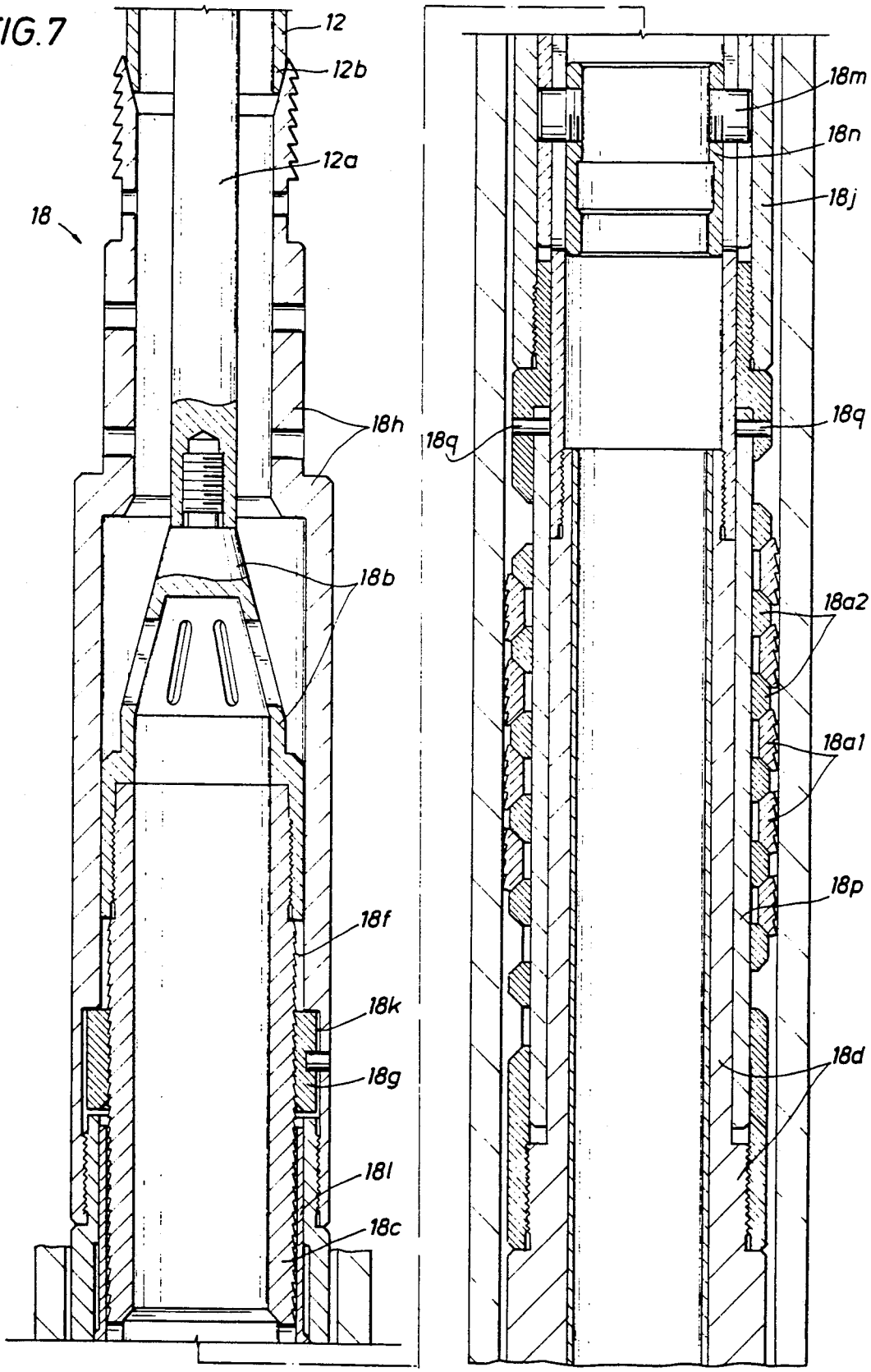
FIG. 7 illustrates the anchor of FIG. 1 when the anchor is set.

Referring to FIGS. 6 and 7, a detailed description of the anchor 18 is illustrated.

In FIG. 6, an anchor 18 is shown in its un-set position, wherein slip coil 18a1 is shown not gripping the borehole casing; in FIG. 7, the anchor 18 is shown in its set position, wherein the slip coil 18a1 is shown gripping the borehole casing. In either FIG. 6 or FIG. 7, the anchor 18 comprises a tension sleeve 18b attached to a first pull mandrel 18c which is attached to a second pull mandrel 18d. The first pull mandrel 18c includes a buttress thread 18f on its outer diameter which mate with buttress thread on the inner diameter of a C-ring ratchet lock 18g. The buttress thread is positioned to allow free upward movement of the tension sleeve 18b and the two pull mandrels when the setting tool 12 is activated, but will not allow them to return to their original positions. The C-ring ratchet lock 18g is trapped in a groove 18k between the anchor top sub 18h and the housing spacer 18j. The groove 18k is designed such that the ratchet is free to expand radially as the first pull mandrel 18c moves upward and the buttress threads 18f move under the ratchet 18g. Disposed annularly between the first pull mandrel 18c and housing spacer 18j is a release sleeve 18l with its upper end positioned so that forced upward movement will slide under the C-ring ratchet 18g forcing it out radially, and disconnecting the ratchet from buttress thread 18f. The release sleeve 18l is connected to the profile sleeve 18n disposed in the lower end of first tension mandrel 18c by lugs 18m. Lugs 18m are positioned in axial slots in first tension mandrel 18c. This arrangement transfers axial movement of profile sleeve 18n to release sleeve 18l when required. Attached between the housing spacer 18j and second tension mandrel 18d is inner spring 18a2. Several turns of a slip coil 18a1 are interleaved with the inner spring 18a2. Half of the slip coils 18a1 have pointed outer cirumferential teeth, which point upwardly, and half of the slip coils have pointed teeth that point downwardly. This allows the anchor 18 to hold force loads which are directed either upwardly or downwardly in the borehole. Inner tube 18p provides alignment of inner spring 18a2 and slip coil 18a1, and is attached to the inner diameter of inner spring 18a2 in two dimensions.

Figure 8:
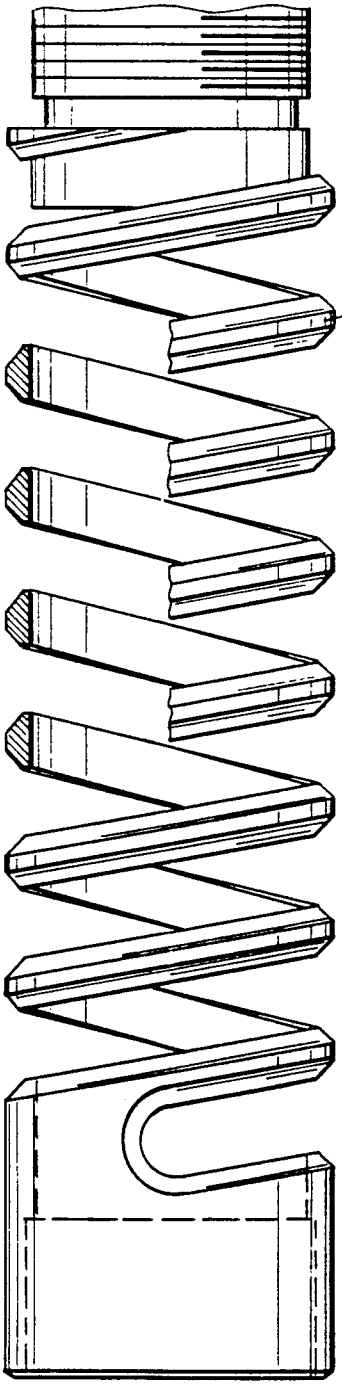
FIG. 8 illustrates the inner spring of the anchor.

FIG. 8 illustrates the inner spring 18a2 in two dimensions.

Figure 9:
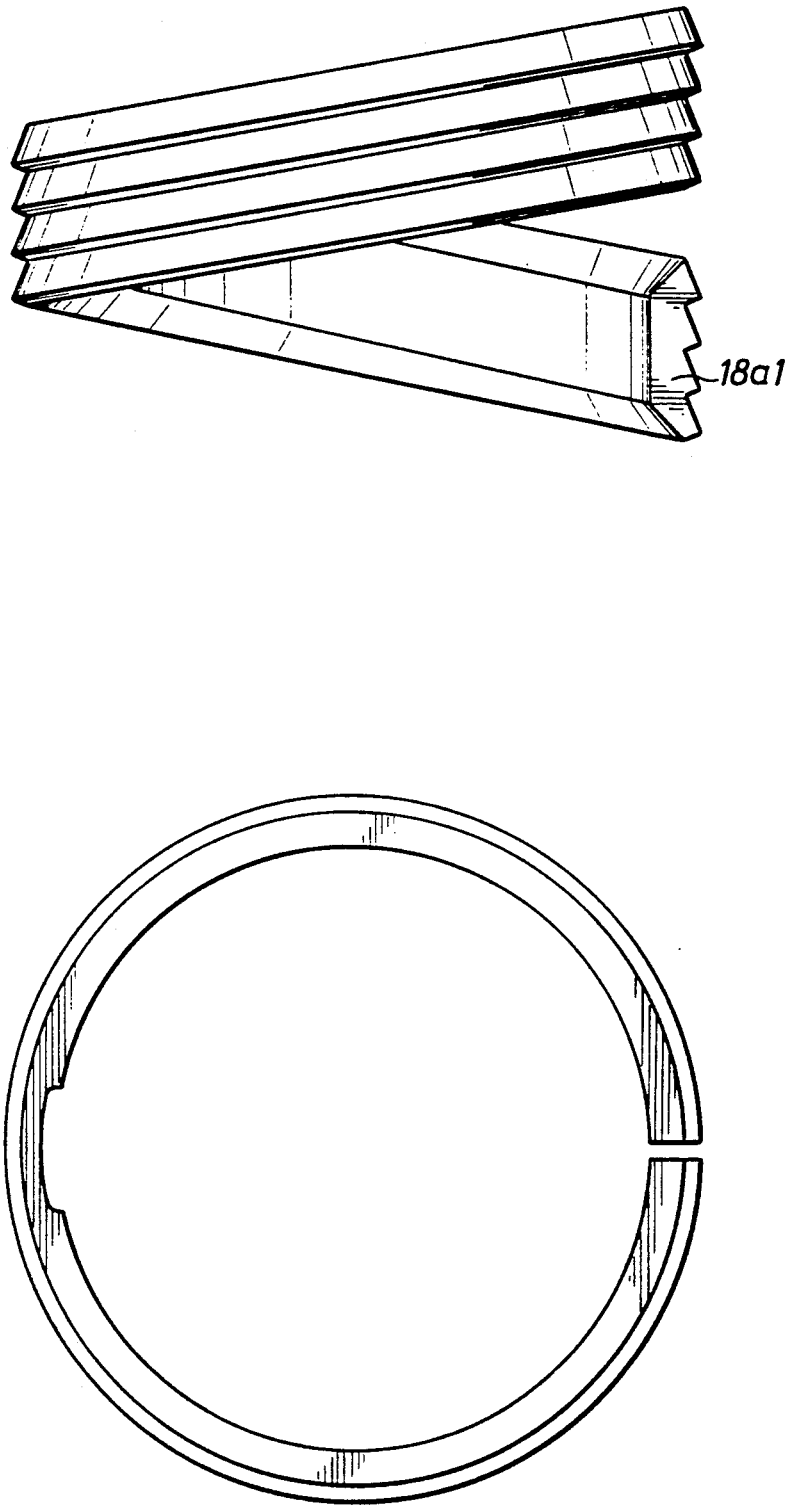
FIG. 9 illustrates the slip coil of the anchor.

FIG. 9 illustrates the slip coil 18a1.

A functional operation of the anchor 18 will be set forth in the following paragraphs with reference to FIG. 6 and 7 of the drawings, FIG. 6 showing the slip coil 18a1 as not gripping the borehole casing, FIG. 7 showing the slip coil 18a1 as gripping the borehole casing.

To set the anchor 18, inner mandrel 12a of setting tool 12 is attached to the anchor tension sleeve 18b. Setting adaptor 12b of setting tool 12 abuts against top sub 18h of anchor 18, preventing upward movement. When it is desired to set the anchor 18, the inductive coupler 10 transmits an electrical initiator signal to the setting tool 12 via conductor 10d2, as shown in FIGS. 4 and 5. The initiator signal ignites a flammable solid in the setting tool 12, thereby producing a gas. The gas causes the setting tool to expand and further cause relative axial motion between the setting tool outer housing and inner mandrel. This relative axial motion by setting tool 12 produces a pulling force on the tension sleeve 18b. As a result, the inner mandrel 12a of setting tool 12, the tension sleeve 18b, and the first and second pull mandrels 18c and 18d move upwardly in the figure and compress inner spring 18a2, the compression of the inner spring 18a2 forcing slip coils 18a1 to expand radially outwardly until the circumferential outward facing teeth of slip coils 18a1 contact and grip the borehole casing. As the first pull mandrel 18c moves up, the buttress threads 18f move through the inner diameter of the mating buttress threads on the ratchet 18g. The ratchet 18g radially expands and contracts to unlock and lock the relative position of the first pull mandrel 18c from the ratchet 18g. When the force load of the slip coils 18a1 is equal to the strength of the tension sleeve 18b, the tension sleeve 18b fails and shears off, thereby disconnecting the inner mandrel 12a of setting tool 12 from the anchor 18. The force load is trapped in the anchor by the buttress thread 18f of first pull mandrel 18c and C-ring ratchet 18g. The buttress threads prevent first pull mandrel 18c from returning to its original and relaxed position. The anchor is now set. The setting tool, neutral release, wireline latch, inductive coupler, and wireline are detached from the anchor and are retrieved through the tubing.

After the perforating gun 22 is detonated, in order to release the anchor 18 and drop the perforating gun 22 to the bottom of the well, two are used: slickline manual operation, or automatic operation by high order detonation of the perforating gun.

Using the slickline method, a jar and shifting tool on the end of slickline has profile keys which engage and lock in the profile recess of profile sleeve 18n. Upward jarring motion on the profile sleeve moves the upper end of release sleeve 18l between the C-ring ratchet 18g and the first pull mandrel 18c which further causes the ratchet 18g to move radially outward. This releases the lock between the ratchet 18g and the first pull mandrel 18c. Inner spring 18a2, in its compressed state, returns to its relaxed uncompressed position, thereby allowing slip coils 18a1 to retract radially inwardly to their relaxed position, and the circumferential teeth on slip coil 18a1 disconnects from the casing. The anchor, firing system, and the guns now fall to the bottom of the well.

Using the pressure operation method, the profile sleeve 18n is shifted upwardly by high order detonation of the perforating guns. An inner sleeve, which is disposed inside the second pull mandrel 18d, abuts the profile sleeve 18n on its upper end and the release sub on its lower end. High order gun detonation allows pressure, created from gun detonation, to force the inner sleeve up, which in turn moves the profile sleeve 18n up, which in turn moves release sleeve 18l between the first pull mandrel 18c and the C-ring ratchet 18g.

The above description of the preferred of the present invention discusses a permanent completion technique, such as underbalance perforating. It should be understood that the underlying concept behind the present invention would work equally well with respect to a temporary completion technique, such as in association with a drill stem test. In fact, such underlying concept would work equally well in association with any instrument which is adapted to be lowered into a borehole for performing an intended function.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

We claim

1. An anchor apparatus for setting an anchor in a wall tool, comprising;

a first helical member having helical turns;

a second helical member interleaved with the turns of said first helical member, the second helical member including gripping means disposed on an outer periphery thereof for gripping a borehole casing;

means for compressing said field helical member, said means for compressing including, a first pull mandrel, a second pull mandrel connected on one end to said first pull mandrel and on the other end to a bottom end of said first helical member, and means for pulling said first pull mandrel, the pull on said first pull mandrel producing a corresponding pull on said second pull mandrel, the pull on said second pull mandrel producing a corresponding pull on said bottom end of said first helical member, the pull on said bottom end compressing said first helical member, the second helical member expanding radially outwardly in response to the compression of said first helical member by said means for compressing until said gripping means of said second helical member grips said borehole casing, the anchor being set when said gripping means grips said borehole casing.

2. The anchor of claim 1, wherein said first pull mandrel comprises first buttress teeth.

3. The anchor of claim 2, further comprising:

a ratchet surrounding said first pull mandrel, said ratchet having second buttress teeth adapted to mate with said first buttress teeth of said first pull mandrel when said ratchet contacts said first pull mandrel.

4. The anchor of claim 3, wherein a load is produced on said second helical member when said gripping means grips said borehole casing, said means for pulling separating from said first pull mandrel when the pull on said means for pulling exceeds said load on said second helical member.

5. The anchor of claim 4, wherein said second buttress teeth of said ratchet firmly holds said first buttress teeth of said first pull mandrel when the means for pulling separates from said first pull mandrel, said anchor remaining set in response to the holding of said first buttress teeth by said second buttress teeth regardless of the separation of said means for pulling from said first pull mandrel.

6. The anchor of claim 5, further comprising:

a release sleeve, the release sleeve adapted to be disposed between said second buttress teeth of said ratchet and said first buttress teeth of said first pull mandrel, the first helical member relaxing when said release sleeve is disposed between said second buttress teeth and said first buttress teeth, the second helical member relaxing when the first helical member relaxes, the anchor being released from said set when said second helical member relaxes.

7. A method of setting an anchor in a well tool, said well tool adapted to be disposed in a borehole, said anchor including a first coil, a second coil interleaved with said first coil and including a gripping means disposed on the outer periphery thereof, a first pull mandrel, and a second pull mandrel connected on one end to said first pull mandrel and on the other end to a bottom end of said first coil, comprising the steps of:

pulling said first pull mandrel;

in response to the pulling step, producing a corresponding pull on said second pull mandrel;

in response to the producing step, further producing a corresponding pull on said bottom end of said first coil thereby compressing said first coil; and radially expanding said second coil response to the compression of said first coil, the anchor being set when said gripping means on said second coil contacts a wall of said borehole.

8. An anchor apparatus for setting an anchor in a well tool, comprising:

a first helical member having helical turns;

a second helical member interleaved with the turns of said first helical member, the second helical member including gripping means disposed on an outer periphery thereof for gripping a borehole casing;

means for compressing said first helical member, said means for compressing including, a pull mandrel connected to a bottom end of said first helical member, and means for pulling said pull mandrel, the pull on said pull mandrel producing a corresponding pull on said bottom end of said first helical member, the pull on said bottom end compressing said first helical member, the second helical member expanding radially outwardly in response to the compression of said first helical member by said means for compressing until said gripping means of said second helical member grips said borehole casing, the anchor being set when said gripping means grips said borehole casing.

* * * * *